US007018255B1

(12) United States Patent
Phillips et al.

(10) Patent No.: US 7,018,255 B1
(45) Date of Patent: Mar. 28, 2006

(54) EXHAUST SYSTEM FOR A MARINE PROPULSION DEVICE HAVING TWO STATIONARY TUBES TO DEFINE AN ANNULAR EXHAUST PASSAGE

(75) Inventors: George E. Phillips, Oshkosh, WI (US); Wayne M. Jaszewski, Jackson, WI (US); Gregory L. Fugar, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 45 days.

(21) Appl. No.: 10/950,998

(22) Filed: Sep. 27, 2004

(51) Int. Cl.
*B63H 21/32* (2006.01)

(52) U.S. Cl. ..... 440/89 R

(58) Field of Classification Search ..... 440/89 R
See application file for complete search history.

(56) References Cited

U.S. PATENT DOCUMENTS

| | | | | |
|---|---|---|---|---|
| 4,289,488 | A * | 9/1981 | Weronke et al. | 440/57 |
| 4,764,136 | A | 8/1988 | Johansson | 440/89 |
| 4,897,057 | A | 1/1990 | McCormick | 440/57 |
| 4,911,666 | A * | 3/1990 | Gage et al. | 440/89 R |
| 4,940,434 | A | 7/1990 | Kiesling | 440/57 |
| 5,083,952 | A | 1/1992 | Bland et al. | 440/89 |
| 5,376,034 | A | 12/1994 | Meisenburg et al. | 440/89 |
| 5,421,756 | A * | 6/1995 | Hayasaka | 440/89 R |
| 5,514,013 | A | 5/1996 | Rodskier | 440/57 |
| 6,350,167 | B1 | 2/2002 | Neisen | 440/112 |
| 6,383,043 | B1 * | 5/2002 | Heston | 440/57 |

* cited by examiner

*Primary Examiner*—Stephen Avila
(74) *Attorney, Agent, or Firm*—William D. Lanyi

(57) ABSTRACT

A marine propulsion system is provided with inner and outer bellows, or tubes, which are rigidly attached to both the transom bracket and the driveshaft housing of the sterndrive system. Neither the inner nor outer tubes rotate with the driveshaft. Both the inner and outer tubes, or bellows, allow the driveshaft to rotate relative to the transom bracket about either a steering axis or trim axis. An exhaust passage is defined between the outer surface of the inner tube and the inner surface of the outer tube. This structure provides an efficient positioning of the two tubes while protecting the universal joint within the inner tube from the exhaust gases. Encompassing the inner tube within the outer tube increases the possible area that can be used for the exhaust passage in comparison to providing two individual tubes, one for the universal joint and the other as an exhaust passage.

26 Claims, 5 Drawing Sheets

EXHAUST SYSTEM FOR A MARINE PROPULSION DEVICE HAVING TWO STATIONARY TUBES TO DEFINE AN ANNULAR EXHAUST PASSAGE

BACKGROUND OF THE INVENTION

1. Field of the Invention

The present invention is generally related to a marine propulsion system and, more particularly, to a marine propulsion system that comprises a first tube that encompasses a second tube with a universal joint located within the second tube and an exhaust passage defined between the first and second tubes.

2. Description of the Prior Art

Those skilled in the art of marine propulsion systems are familiar with sterndrive devices in which exhaust gases are directed from an engine location within a marine vessel, through a transom of the vessel, and through a drive unit attached to the transom so that exhaust gases can be emitted below water level or otherwise through a portion of the sterndrive structure.

U.S. Pat. No. 4,764,136, which issued to Johansson on Aug. 16, 1988, describes a marine drive means. The invention relates to a marine drive comprising a water cooled internal combustion engine mounted in a boat, a shield mounted on the transom stern of the boat and supporting a universal joint housing and a pinion box connected to the universal joint housing and comprising a propeller arranged to be immersible in the water.

U.S. Pat. No. 4,897,057, which issued to McCormick on Jan. 30, 1990, discloses a marine propulsion unit universal drive assembly. The marine propulsion device has a flexible bellows surrounding the universal joint disposed between a marine engine and a sterndrive unit and is mounted to rotate with the universal joint itself. The universal joint is disposed within a chamber delineated by the bellows itself and by end caps mounted to the universal joint shafts. Supports for the universal joint bearings are constructed to permit free flow of fluid around the bearings. A quantity of lubricating oil is supplied to the chamber and at least partially fills the chamber when the latter is at rest. Upon driving rotation of the device, the bellows and universal joint and lubricating oil all rotate together. The resultant centrifugal force causes the oil to flow radially outwardly through the bearing supports to lubricate the bearings, with the oil forming a rotating mass engaging the inner bellows face. To support the bellows against the rotating mass, a helical spring is mounted externally of the bellows and within the bellows convolutions, with the spring being anchored adjacent both ends of the bellows. In addition, the bellows function as a finned heat radiator.

U.S. Pat. No. 4,940,434, which issued to Kiesling on Jul. 10, 1990, discloses a marine propulsion unit universal drive assembly with through-bellows exhaust. A marine propulsion device is provided wherein a pair of generally telescoped bellows surround the universal joint and provide an exhaust passage therebetween which communicates between the inboard engine and the sterndrive unit. In the embodiment disclosed, the inner bellows rotates with the universal joint while the outer bellows is stationary. The bellows are preferably of helical or spiral configuration and the rotating inner bellows forms an exhaust pump. In one embodiment, the bellows are concentrically disposed while in another embodiment the bellows are eccentrically mounted.

U.S. Pat. No. 5,083,952, which issued to Bland et al. on Jan. 28, 1992, describes a marine propulsion device exhaust system. A sterndrive unit comprising a gimbal housing which is adapted to be mounted on the transom of a boat and which has therein an exhaust water passage including a forwardly opening inlet, a rearwardly opening inlet, an exhaust conducting portion, a water conducting portion, and a water outlet communicating with the water conducting portion is disclosed.

U.S. Pat. No. 5,376,034, which issued to Meisenburg et al. on Dec. 27, 1994, discloses a marine drive exhaust system. A surfacing marine drive has a drive housing with a fore exhaust passage forward of the vertical bore housing the driveshaft, right and left exhaust passages extending rearwardly from the fore exhaust passage on opposite right and left sides of the vertical bore, and an aft exhaust passage extending rearwardly from the right and left exhaust passages and aft of the vertical bore and discharging exhaust into dual counter-rotating surface operating propellers.

U.S. Pat. No. 5,514,013, which issued to Rodskier on May 7, 1996, describes a boat propulsion unit. The propulsion unit is adapted to be suspended on the outside of a boat transom and drivably connected to an engine on the inside of the transom. The unit comprises a propeller driveshaft housing, a suspension arrangement adapted to be fixedly secured to the transom, a pivot which pivotally connects the driveshaft housing to the suspension arrangement to allow pivotal displacement of the driveshaft housing relative to the suspension arrangement about a pivot axis in a vertical plane and pivot axis in a horizontal plane, a steering device which is arranged to effect pivotal displacement of the driveshaft housing about first-mentioned axis, and a trim and tilt device which is arranged to effect pivotal displacement of the driveshaft housing about the second-mentioned axis.

U.S. Pat. No. 6,350,167, which issued to Neisen on Feb. 26, 2002, describes an inflatable transom seal and techniques for assembling such seal in a sterndrive. A transom seal assembly for sealing an opening in a boat transom is provided. A propulsion system has a part thereof extending through the transom opening. The seal assembly comprises an inflatable seal between respective peripheries of the part and the transom opening to provide water tight sealing relative to the interior of the boat even in the presence of a seal puncture condition.

The patents described above are hereby expressly incorporated by reference in the description of the present invention.

SUMMARY OF THE INVENTION

A marine propulsion system made in accordance with a preferred embodiment of the present invention comprises a transom bracket which is attachable to a transom of a marine vessel, a driveshaft housing movably attached to the transom bracket, a first shaft supported for rotation within the driveshaft housing, and a second shaft connected in torque transmitting relation with the first shaft. The second shaft extends through the transom bracket. A universal joint is connected in torque transmitting relation between the first and second shafts. A preferred embodiment of the present invention further comprises a first tube rigidly attached to the transom bracket and to the driveshaft housing. A second tube is rigidly attached to the transom bracket and to the driveshaft housing. The second tube is disposed within the first tube with the universal joint being disposed within the second tube.

A particularly preferred embodiment of the present invention further comprises an inner transom bracket attached to a first end of the first tube and to a first end of the second tube. The inner transom bracket is attached to the transom bracket. The driveshaft housing is attached to a second end of the first tube and to a second end of the second tube. The first tube is a bellows and the second tube is a bellows.

In a preferred embodiment of the present invention, the first and second tubes each comprise a metallic bellows. The first shaft is connectable in torque transmitting relation with a crankshaft of an engine. The first and second tubes are arranged to define a generally annular exhaust passage between an outer surface of the second tube and an inner surface of the first tube. The first tube encompasses the second tube. In a preferred embodiment of the present invention, the first and second tubes are not concentric with each other.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
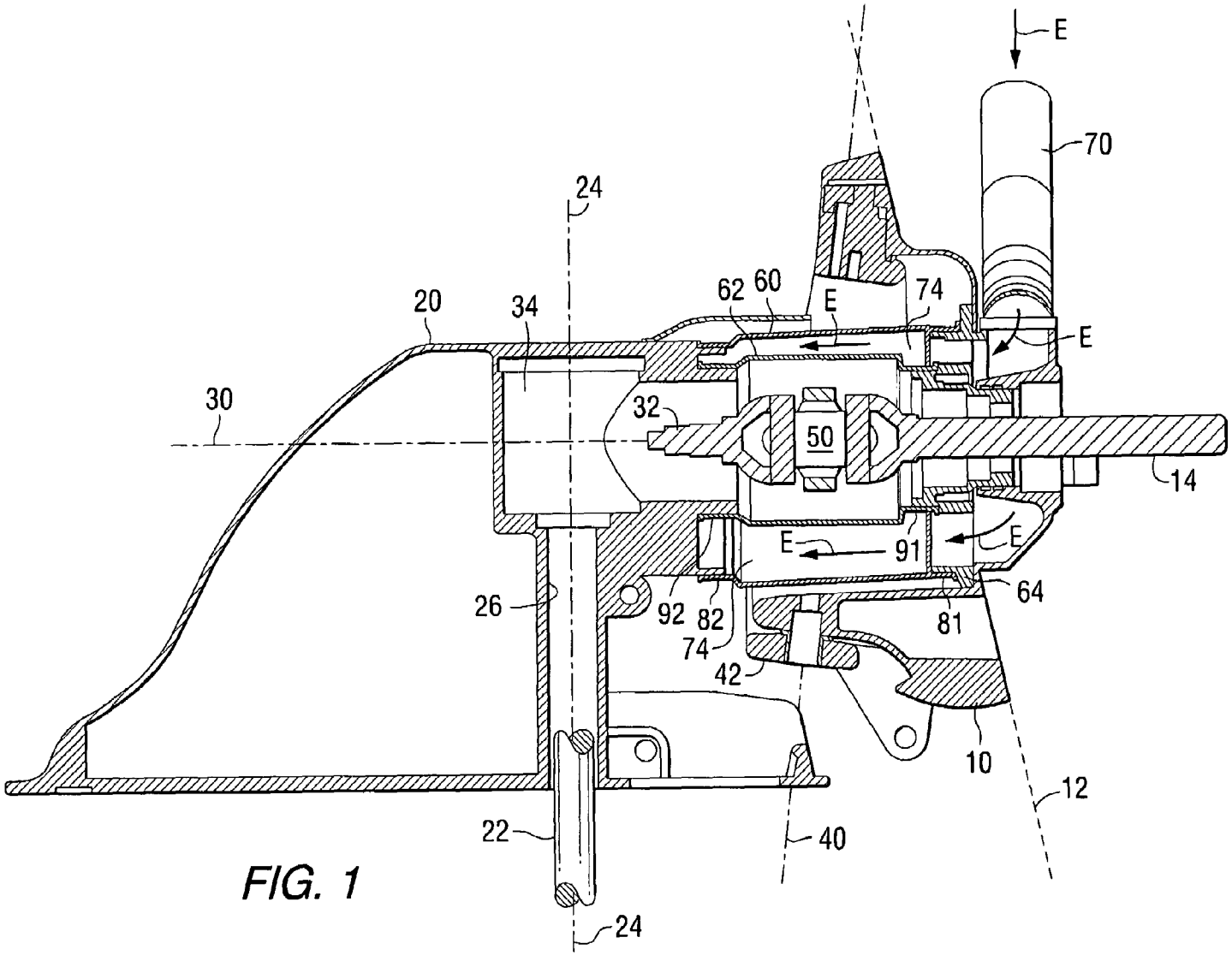
FIG. 1 is a side section view of the present invention.

Throughout the description of the preferred embodiment of the present invention, like components will be identified by like reference numerals.

FIG. 1 is a section view of a marine propulsion system incorporating the concepts of a preferred embodiment of the present invention. A transom bracket 10 is attachable to a transom of a marine vessel. Dashed line 12 represents the rear surface of the transom of a marine vessel against which the transom bracket 10 is attached. Through an opening formed in the transom of the marine vessel, a horizontal driveshaft 14 extends toward an internal combustion engine (not shown in FIG. 1) which is contained within the structure of the marine vessel. The horizontal driveshaft 14 is typically connected to a crankshaft of the engine which is aligned in coaxial relation with the horizontal driveshaft 14. Also shown in FIG. 1 is a driveshaft housing which supports a vertical driveshaft 22 that is disposed in the opening identified by reference numeral 24. The vertical driveshaft 22 is supported for rotation about vertical axis 26.

As can be seen in FIG. 1, the vertical axis 26 of the vertical driveshaft 22 intersects horizontal axis 30 of the horizontal driveshaft extension 32. Throughout the description of the preferred embodiment of the present invention, the term "universal joint" will be used to describe any component which allows torque to be transferred from the horizontal driveshaft 14 to the horizontal driveshaft extension 32 even though those two shafts may not be coaxial. It should be understood that this term "universal joint" is intended to encompass within its definition all devices that perform this function of transferring torque through a flexible joint. It should also be recognized that this term includes many different types of components (e.g. a constant velocity joint) that serve this purpose even though they may not directly be configured in the manner normally described by the term "universal joint". In the space identified by reference numeral 34, appropriate bevel gears are supported within the driveshaft housing 20 to transmit torque from the horizontal driveshaft extension 32 to the vertical driveshaft 22 which is supported within the opening 24. Also shown in FIG. 1 is the steering axis 40 about which the driveshaft housing 20 rotates to allow the marine vessel to be steered. Reference numeral 42 identifies a gimbal ring.

With continued reference to FIG. 1, reference numeral 50 identifies a universal joint which is connected in torque transmitting relation between the horizontal driveshaft 14 and the horizontal driveshaft extension 32. When the driveshaft housing 20 is rotated about its steering axis 40 or trimmed about a generally horizontal trim axis, which also extends through the universal joint 50, the horizontal driveshaft 14 remains in the position shown in FIG. 1 while the horizontal driveshaft extension 32 moves in coordination with the movement of the driveshaft housing 20. The use of a universal joint 50 in conjunction with a sterndrive system for a marine vessel is well known to those skilled in the art and will not be described in greater detail below. In addition, the method by which the bevel gears in the region identified by reference numeral 34 and a vertical driveshaft 22 in the opening identified by reference numeral 24 operate in conjunction with the horizontal driveshaft extension 32 will not be described in significant detail herein because that interaction is well known to those skilled in the art.

A first tube 60 and a second tube 62 are shown in FIG. 1 where they are disposed around the universal joint 50. An internal transom bracket 64 is shown attached to the first and second tubes, 60 and 62, and to the transom bracket 10.

With continued reference to FIG. 1, the transom bracket 10 is attachable to a transom of a marine vessel with a driveshaft housing 20 being movably attached to the transom bracket 10. A first shaft, such as the vertical driveshaft 22, is supported for rotation within the driveshaft housing 20. A second shaft, such as the horizontal driveshaft 14, is connected in torque transmitting relation with the first shaft 22. The second shaft 14 extends through the transom bracket 10 as shown in FIG. 1. The universal joint 50 is connected in torque transmitting relation between the first and second shafts, 22 and 14. A first tube 60 is rigidly attached to the transom bracket 10 and to the driveshaft housing 20. A second tube 62 is rigidly attached to the transom bracket 10 and to the driveshaft housing 20.

The second tube 62 is disposed within the first tube 60 and the universal joint 50 is disposed within the second tube 62.

With continued reference to FIG. 1, arrows E illustrate the path that exhaust gases follow as they pass through an exhaust pipe 70, through the transom bracket 10, and through an exhaust passage 74 which is defined between the outer surface of the second tube 62 and the inner surface of the first tube 60. This exhaust passage 74 is generally annular in shape, but it should be clearly understood that it is not necessarily uniform in dimension around the periphery of the second tube 62. In other words, the first and second tubes, 60 and 62, are not necessarily concentric or coaxial with each other. In certain embodiments of the present invention, the first and second tubes, 60 and 62, can be generally concentric or coaxial with each other, but this is not necessary to achieve the benefits provided by the present invention.

An inner transom bracket 64 is attached to a first end 81 of the first tube 60 and a first end 91 of the second tube 62. The inner transom bracket 64 is attached to the transom bracket 10. The driveshaft housing 20 is attached to a second end 82 of the first tube 60 and a second end 92 of the second tube 62. As will be described below, the use of the inner transom bracket 64 provides the ability to more easily assemble the structure shown in FIG. 1 with both the first and second tubes, 60 and 62, being rigidly attached at their ends to the transom bracket 10 and driveshaft housing 20. Since the inner transom bracket 64 is attachable to the transom bracket 10, the first and second tubes, 60 and 62, are more easily rigidly attached to the transom bracket 10.

In a particularly preferred embodiment of the present invention, the first and second tubes, 60 and 62, are bellows and, in one particularly advantageous embodiment of the present invention, they are metallic bellows. As described above, the first shaft, which can be the horizontal driveshaft 14, is connectable in torque transmitting relation with a crankshaft of an engine in the marine vessel. Since those skilled in the art of marine propulsion systems are well aware of this relationship between an internal combustion engine contained in the marine vessel and a sterndrive unit attached to the transom of that vessel, the means for attaching these shafts together will not be described in detail herein.

Figure 2:
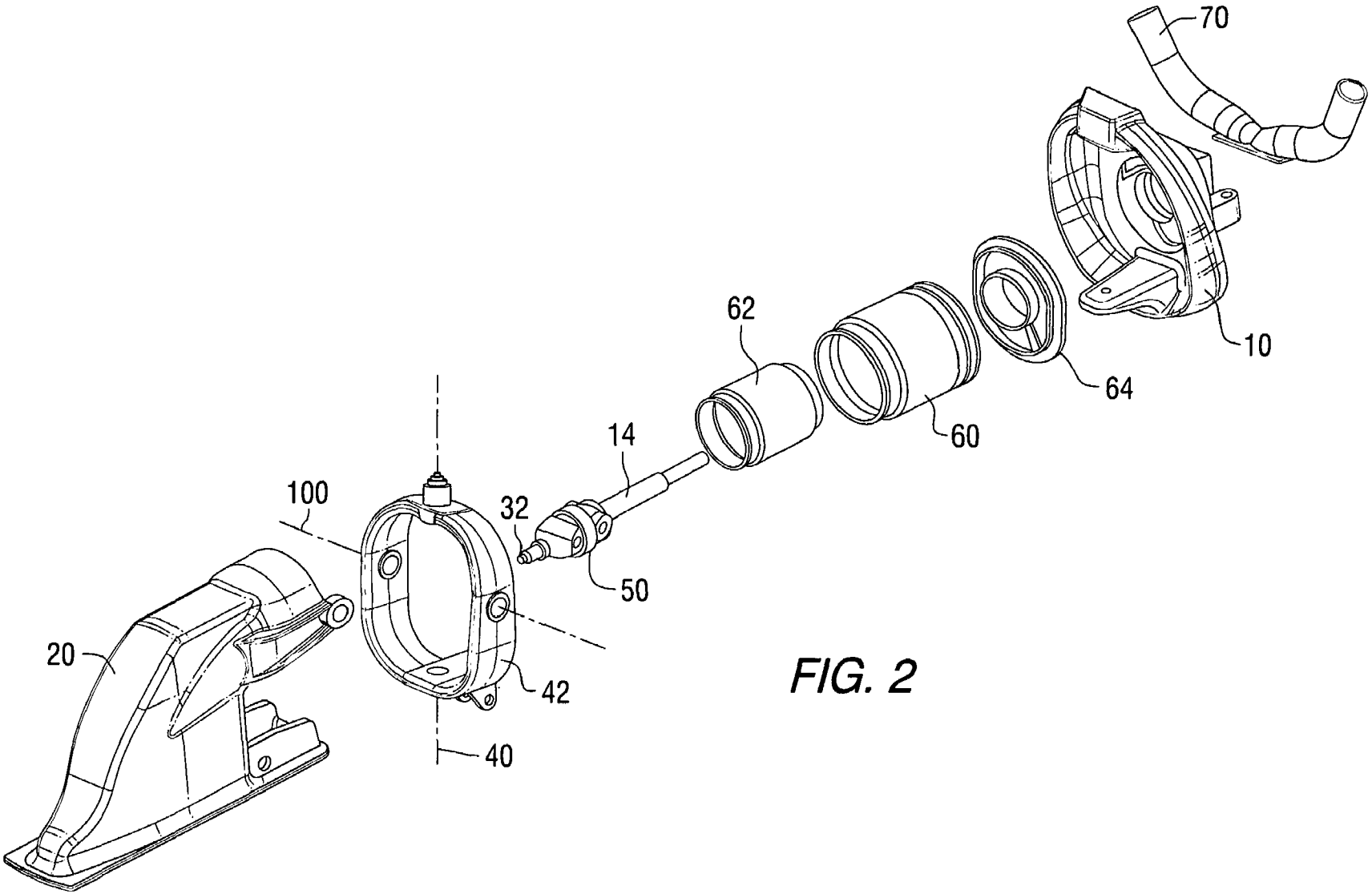
FIG. 2 is an exploded isometric view of the present invention.

FIG. 2 shows an exploded isometric view of the marine propulsion system shown in FIG. 1. The driveshaft housing 20 is movably attachable to the gimbal ring 42 for rotation about a trim axis 100. The gimbal ring 42 is rotatably attached to the transom bracket 10 for rotation about the steering axis 40. The universal joint 50 is shown with the second shaft, such as the horizontal driveshaft 14, and the horizontal driveshaft extension 32 attached to it. The first and second tubes, 60 and 62, are shown separated from the inner transom bracket 64 which is attachable to the transom bracket 10. Also shown in FIG. 2 is the exhaust pipe 70 through which exhaust gases are directed toward the annular space between the first and second tubes, 60 and 62.

Figure 3:
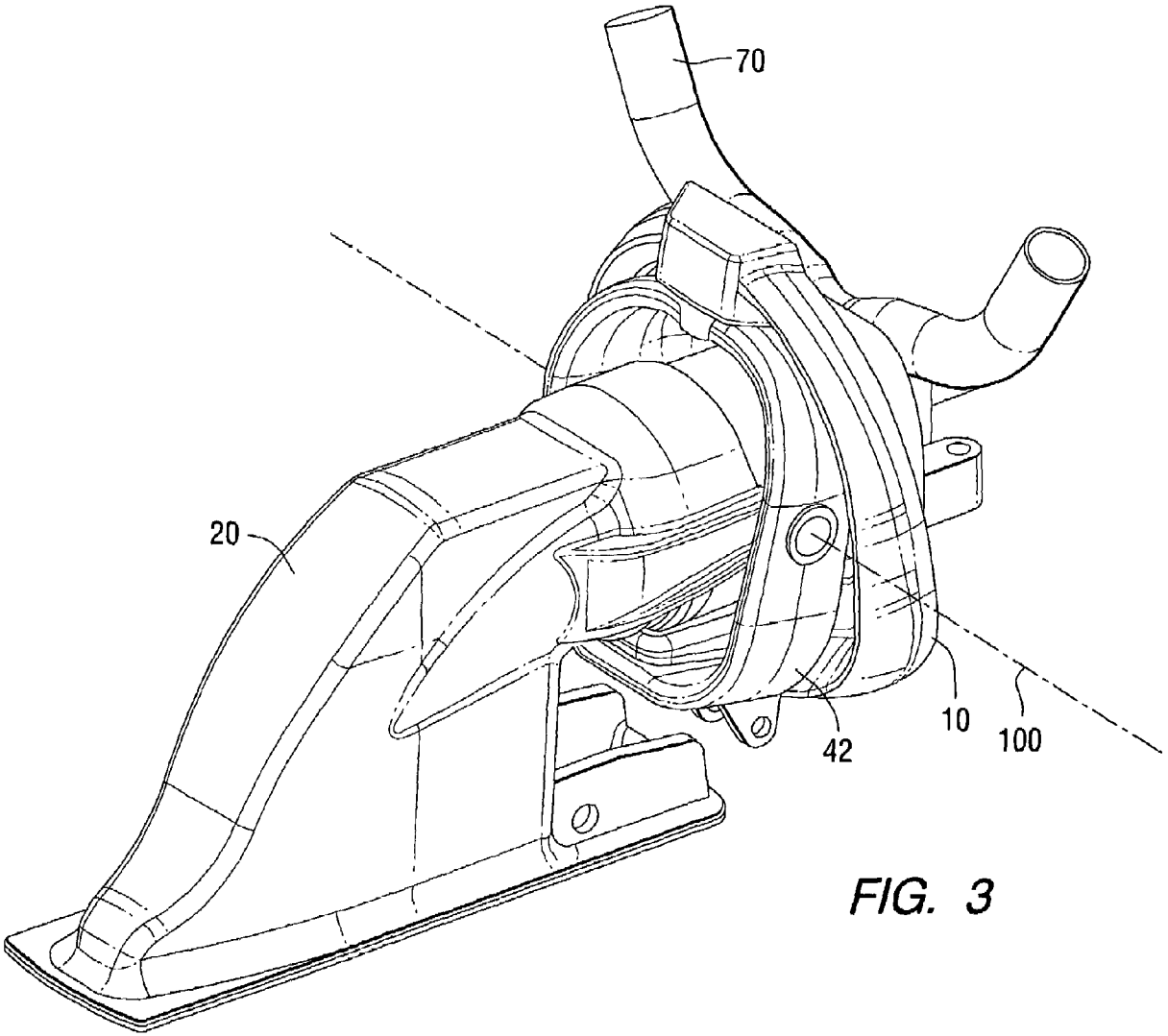
FIG. 3 is an assembled isometric view of the present invention.

FIG. 3 shows the driveshaft housing 20 and the gimbal ring 42 assembled together in association with the exhaust pipe 70. The first and second tubes, 60 and 62, are not visible in the assembled isometric view of FIG. 3. The trim axis 100 is also shown in FIG. 3.

Figure 4:
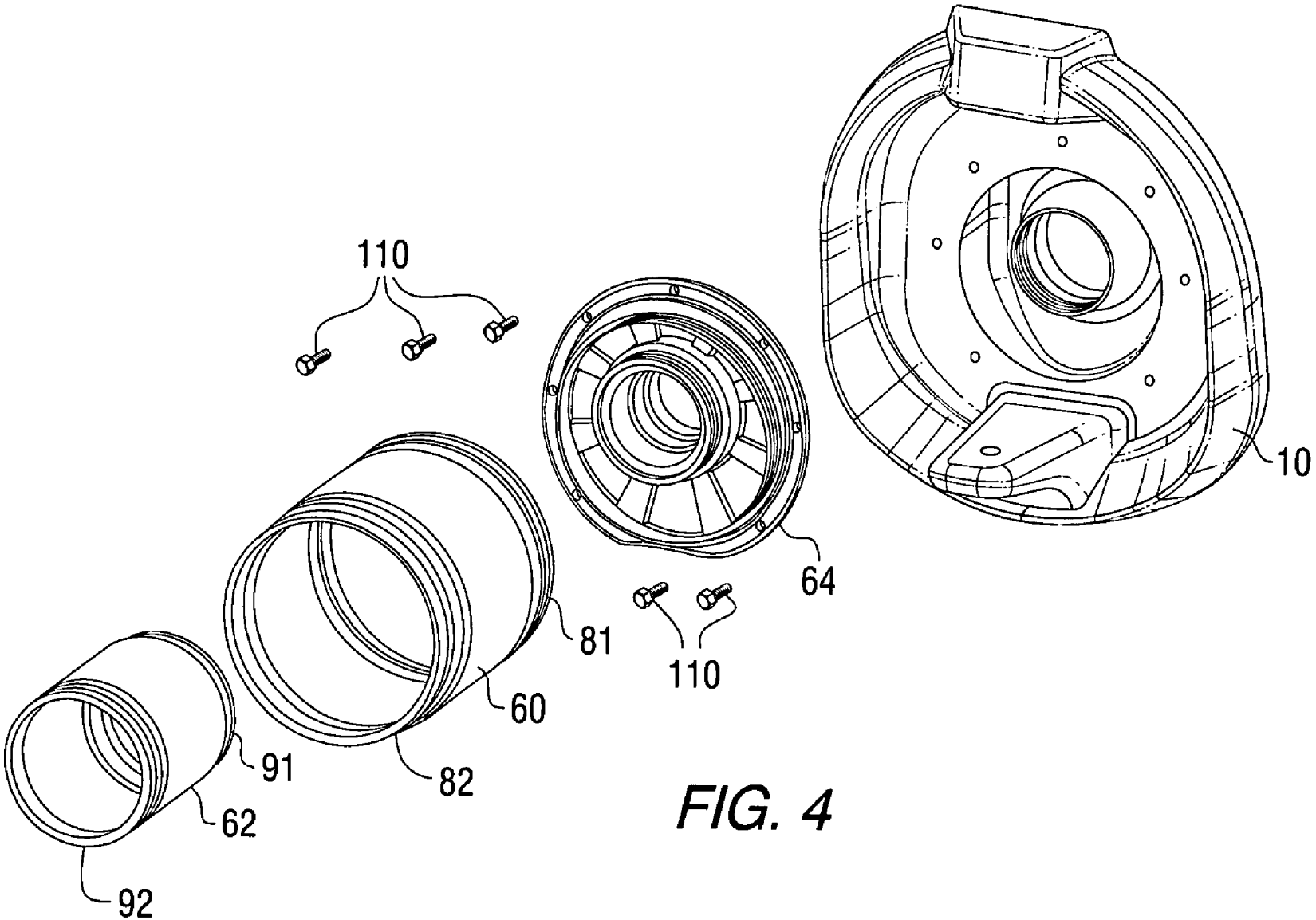
FIG. 4 is an exploded isometric view of an inner transom bracket, a transom bracket, and the inner and outer tubes of the present invention.

FIG. 4 is an isometric exploded view of the inner transom bracket 64 shown in relation to the transom bracket 10. Five bolts 110 are used to rigidly attach the inner transom bracket 64 to the transom bracket 10. Both the first 60 and second 62 tubes are rigidly attachable at their first ends, 81 and 91, respectively, to the inner transom bracket 64 prior to the attachment of the inner transom bracket 64 to the transom bracket 10.

Figure 5:
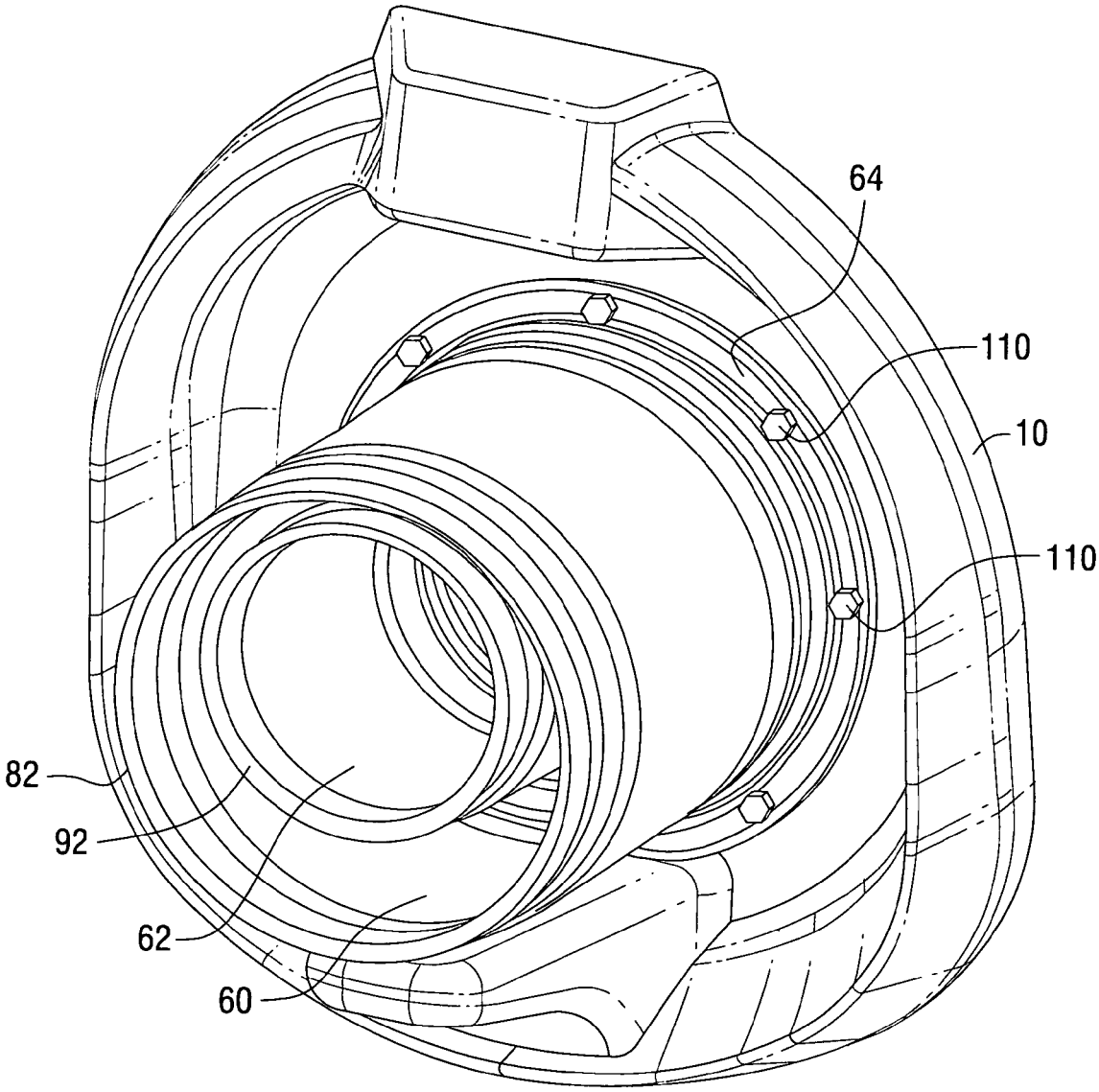
FIG. 5 is an assembled isometric view of an inner transom bracket, a transom bracket, and the inner and outer tubes of the present invention.

FIG. 5 is an assembled isometric view of the transom bracket 10, the inner transom bracket 64, and the first and second tubes, 60 and 62. The bolts 110 are shown to illustrate the method by which the inner transom bracket 64 is rigidly attached to the transom bracket 10.

In the prior art, it is generally known that bellows can be used to surround and protect the universal joint in a marine propulsion system. This concept is illustrated in U.S. Pat. No. 4,764,136, which is discussed above. It is also known that two independent bellows can be disposed, one inside the other, to surround the universal joint and to also create an annular passage between the outer surface of the inner bellows and the inner surface of the outer bellows. This is shown in U.S. Pat. No. 4,940,434. However, when two bellows are used, in the manner disclosed in U.S. Pat. No. 4,940,434, the inner bellows is attached for rotation to the universal joint and its associated driveshaft. This type of attachment is shown in U.S. Pat. Nos. 4,897,057 and 4,940,434. However, when the driveshaft housing is rotated relative to the horizontal driveshaft attached to the engine, during either a trimming or a steering event, and the horizontal driveshaft is rotating, the inner bellows is rapidly and repeatedly flexed because the universal joint is disposed at an angle and the rotating inner bellows must rotate with the two shafts to which the universal joint is attached. This flexing occurs at a rate equal to the rotational speed of the horizontal driveshaft. In other words, with reference to FIG. 1, if an inner bellows was rigidly attached to the second shaft 14 and to the horizontal driveshaft extension 32, for rotation with the universal joint 50, and the driveshaft housing 20 is rotated either about the steering axis 40 or the trim axis 100 (which is illustrated in FIG. 2), the rotating inner bellows would be disposed at the angle between the second shaft 14 and the horizontal driveshaft extension 32. During each rotation of those two shafts and the attached universal joint 50, the inner bellows would have to flex completely from one extreme position to the opposite extreme position. This constant flexing, at the rotational speed of the second shaft 14, can easily cause damage to the inner bellows through fatigue.

It is believed that known marine propulsion systems utilize the attachment of an inner bellows for rotation with the universal joint because this simplifies the assembly effort when the inner and outer bellows are assembled to the driveshaft housing and transom bracket. This ease in assembly would be beneficial when replacing either of the two bellows or when removing the drive unit from the transom for any other reason. The present invention provides an inner transom bracket 64 which allows both of the first and second tubes, 60 and 62, to be rigidly supported without contact to the second shaft 14, the horizontal-driveshaft extension 32, or the universal joint 50. This eliminates the potential damage that could occur to the inner bellows if it was attached directly to those horizontally rotating shafts and universal joint 50. This advantage is made possible by the use of the inner transom bracket 64 which allows it to be preattached to the inner and outer bellows, or first and second tubes, 60 and 62, prior to its being attached to the transom bracket 10.

In a preferred embodiment of the present invention, an exhaust passage is provided which is generally annular in shape surrounding an inner bellows, or second tube 62, which is disposed around the universal joint. In view of the confined space of the opening through the transom of a marine vessel, placement of the universal joint and an exhaust passage at separate locations severely limits the available cross-sectional area that is usable for the flow of exhaust gases from the engine within the marine vessel. By locating these openings in overlapping relation, with the universal joint passing through an opening that is contained within and surrounded by a larger tube or bellows, a generally annular exhaust space enables a larger area to be used as the exhaust passage. It should be understood that in a preferred embodiment of the present invention, the generally annular space is not truly annular in the sense that the dimension between the inner and outer bellows, or inner and outer tubes, is constant around the periphery of the structure. Instead, the center of the inner bellows or tube is typically offset from the center of the outer bellows or tube. This offset relationship is done for reasons that are not directly related to advantages of the present invention. The use of an inner transom assembly enables the structure of the present invention to be accomplished without the requirement of a significantly difficult assembly procedure.

In a preferred embodiment of the present invention, the first tube 60 encompasses the second tube 62. Although they can be concentric and coaxial, the first and second tubes have centers that are offset from each other in a preferred embodiment of the present invention. The first and second tubes, 60 and 62, can be bellows structures and, in a particularly preferred embodiment, they can be metallic bellows. The first and second tubes can be attached to the inner transom bracket 64 and to the driveshaft housing 20 through the use of metallic bands in a manner that is generally known to those skilled in the art. The inner transom bracket can then be bolted to the transom bracket during the assembly of the driveshaft housing 20 to the transom bracket 10 and the assembly of the driveshaft housing 20 to a marine vessel.

Although the present invention has been described in considerable detail and illustrated to specifically show a preferred embodiment, it should be understood that alternative embodiments are also within its scope.

We claim:

1. A marine propulsion system, comprising:

a transom bracket which is attachable to a transom of a marine vessel;

a driveshaft housing rotatably attached to said transom bracket;

a first shaft supported for rotation within said driveshaft housing;

a second shaft connected in torque transmitting relation with said first shaft, said second shaft extending through said transom bracket;

a universal joint connected in torque transmitting relation between said first and second shafts;

a first tube rigidly attached to said transom bracket and to said driveshaft housing; and a second tube rigidly attached to said transom bracket and to said driveshaft housing, said second tube being disposed within said first tube, said universal joint being disposed within said second tube.

2. The marine propulsion system of claim 1, further comprising:

an inner transom bracket attached to a first end of said first tube and a first end of second tube, said inner transom bracket being attached to said transom bracket.

3. The marine propulsion system of claim 2, wherein:

said driveshaft housing is attached to a second end of said first tube and a second end of second tube.

4. The marine propulsion system of claim 1, wherein:

said first tube is a bellows.

5. The marine propulsion system of claim 1, wherein:

said second tube is a bellows.

6. The marine propulsion system of claim 1, wherein:

said first tube is a metallic bellows.

7. The marine propulsion system of claim 1, wherein:

said second tube is a metallic bellows.

8. The marine propulsion system of claim 1, wherein:

said first shaft is connectable in torque transmitting relation with a crankshaft of an engine.

9. The marine propulsion system of claim 1, wherein:

said first and second tubes being arranged to define a generally annular exhaust passage between an outer surface of said second tube and an inner surface of said first tube, said first tube encompassing said second tube.

10. The marine propulsion system of claim 9, wherein:

said first and second tubes being nonconcentric with each other.

11. A marine propulsion system, comprising:

a transom bracket which is attachable to a transom of a marine vessel;

a driveshaft housing rotatably attached to said transom bracket;

a first shaft supported for rotation within said driveshaft housing;

a second shaft connected in torque transmitting relation with said first shaft, said second shaft extending through said transom bracket;

a universal joint connected in torque transmitting relation between said first and second shafts;

a first bellows rigidly attached to said transom bracket and to said driveshaft housing; and a second bellows rigidly attached to said transom bracket and to said driveshaft housing, said second bellows being disposed within said first bellows, said universal joint being disposed within said second bellows, said first and second bellows being arranged to define a generally annular exhaust passage between an outer surface of said second bellows and an inner surface of said first bellows.

12. The marine propulsion system of claim 11, further comprising:

an inner transom bracket attached to a first end of said first bellows and a first end of second bellows, said inner transom bracket being attached to said transom bracket.

13. The marine propulsion system of claim 12, wherein:

said driveshaft housing is attached to a second end of said first bellows and a second end of second bellows.

14. The marine propulsion system of claim 13, wherein:

said first bellows is a metallic bellows; and said second bellows is a metallic bellows.

15. The marine propulsion system of claim 11, wherein:

said first and second bellows are disposed in nonconcentric relation with each other.

16. The marine propulsion system of claim 13, further comprising:

an exhaust pipe connected in fluid communication with said generally annular exhaust passage defined by said first and second bellows, said exhaust pipe being connectable in fluid communication with an exhaust system of an engine.

17. A marine propulsion system, comprising:

a transom bracket which is attachable to a transom of a marine vessel;

a driveshaft housing rotatably attached to said transom bracket;

a first shaft supported for rotation within said driveshaft housing;

a second shaft connected in torque transmitting relation with said first shaft, said second shaft extending through said transom bracket;

a universal joint connected in torque transmitting relation between said first and second shafts;

a first tube rigidly attached to said transom bracket and to said driveshaft housing;

a second tube rigidly attached to said transom bracket and to said driveshaft housing, said second tube being disposed within said first tube, said universal joint being disposed within said second tube, said first and second tubes being arranged to define a generally annular exhaust passage between an outer surface of said second tube and an inner surface of said first tube; and an inner transom bracket attached to a first end of said first tube and a first end of second tube, said inner transom bracket being attached to said transom bracket, said driveshaft housing being attached to a second end of said first tube and a second end of second tube.

18. The marine propulsion system of claim 17, wherein:

said first tube is a bellows; and said second tube is a bellows.

19. The marine propulsion system of claim 18, wherein:

said first tube is a metallic bellows; and said second tube is a metallic bellows.

20. The marine propulsion system of claim 17, further comprising:

an exhaust pipe connected in fluid communication with said generally annular exhaust passage defined by said first and second tubes, said exhaust pipe being connectable in fluid communication with an exhaust system of an engine.

21. A marine propulsion system, comprising:

a transom bracket which is attachable to a transom of a marine vessel;

a driveshaft housing rotatably attached to said transom bracket;

a first shaft supported for rotation within said driveshaft housing;

a second shaft connected in torque transmitting relation with said first shaft, said second shaft extending through said transom bracket;

a universal joint connected in torque transmitting relation between said first and second shafts;

a first bellows rigidly attached to said transom bracket and to said driveshaft housing;

a second bellows rigidly attached to said transom bracket and to said driveshaft housing, said second bellows being disposed within said first bellows, said universal joint being disposed within said second bellows, said first and second bellows being arranged to define a generally annular exhaust passage between an outer surface of said second bellows and an inner surface of said first bellows; and an inner transom bracket attached to a first end of said first bellows and a first end of second bellows, said inner transom bracket being attached to said transom bracket, said driveshaft housing being attached to a second end of said first bellows and a second end of second bellows.

22. The marine propulsion system of claim 21, wherein:

said first bellows is a metallic bellows; and said second bellows is a metallic bellows.

23. The marine propulsion system of claim 22, further comprising:

an exhaust pipe connected in fluid communication with said generally annular exhaust passage defined by said first and second bellows.

24. The marine propulsion system of claim 23, wherein:

said exhaust pipe is connectable in fluid communication with an exhaust system of an engine.

25. The marine propulsion system of claim 21, wherein:

said second bellows is encompassed within said first bellows.

26. The marine propulsion system of claim 21, wherein:

said generally annular exhaust passage being nonuniform in dimension between said first and second bellows.

* * * * *